US009905140B2

(12) United States Patent
Sims

(10) Patent No.: US 9,905,140 B2
(45) Date of Patent: Feb. 27, 2018

(54) FUEL PUMP SIGN

(71) Applicant: Gary Sims, Hertfordshire (GB)

(72) Inventor: Gary Sims, Hertfordshire (GB)

( * ) Notice: Subject to any disclaimer, the term of this patent is extended or adjusted under 35 U.S.C. 154(b) by 189 days.

(21) Appl. No.: 14/760,650

(22) PCT Filed: Jan. 15, 2013

(86) PCT No.: PCT/GB2013/050074

§ 371 (c)(1),
(2) Date: Jul. 13, 2015

(87) PCT Pub. No.: WO2014/111671

PCT Pub. Date: Jul. 24, 2014

(65) Prior Publication Data

US 2015/0356892 A1 Dec. 10, 2015

(51) Int. Cl.

| | |
|---|---|
| ***G09F 7/02*** | (2006.01) |
| ***G09F 13/22*** | (2006.01) |
| ***G09F 23/00*** | (2006.01) |
| ***G09F 3/12*** | (2006.01) |
| ***G09F 7/10*** | (2006.01) |

(52) U.S. Cl.

CPC ..... *G09F 7/02* (2013.01); *G09F 3/12* (2013.01); *G09F 7/10* (2013.01); *G09F 13/22* (2013.01); *G09F 23/0083* (2013.01); *G09F 2013/222* (2013.01)

(58) Field of Classification Search

CPC ..... G09F 7/02; G09F 7/10; G09F 23/0083
See application file for complete search history.

(56) References Cited

U.S. PATENT DOCUMENTS 1,480,606 A * 1/1924 Fetters ..... G09F 15/0006 40/107
1,614,792 A * 1/1927 Joiner ..... G09F 7/20 40/588
1,625,309 A * 4/1927 Frye et al. ..... G09F 7/20 40/588

(Continued)

FOREIGN PATENT DOCUMENTS

DE 298 17 144 U1 12/1998
EP 0 872 824 A1 10/1998

(Continued)

OTHER PUBLICATIONS

Examination Report No. 1 for copending Australian Application No. 2013373705, 9 pages, Feb. 28, 2017.

(Continued)

*Primary Examiner* — Gary C Hoge
(74) *Attorney, Agent, or Firm* — Kagan Binder, PLLC

(57) ABSTRACT

A fuel pump sign (50) comprising a fuel type indicator panel (52) for indicating the type of fuel supplied by a pump, and a pump availability indicator panel (54) for indicating whether the pump is available for use. Also disclosed is a method of use of a display panel having a plurality of display areas as a fuel pump sign for indicating whether or not a fuel pump is available for use. The method of use comprises displaying an indication of a fuel type supplied by the pump on a first display area of the display panel, and displaying an indication of whether or not the pump is available for use on a second display area of the display panel.

15 Claims, 10 Drawing Sheets

(56) References Cited

U.S. PATENT DOCUMENTS 3,685,184 A * 8/1972 Snyder, Jr. ..... G09F 7/18 40/609
3,740,881 A * 6/1973 Finger ..... G09F 7/22 116/63 P
3,882,618 A * 5/1975 Hart ..... G09F 7/00 40/609
4,292,751 A * 10/1981 Snyder, Jr. ..... G09F 11/29 40/517
4,583,311 A * 4/1986 Hosey ..... G09F 15/0012 40/605
4,648,169 A * 3/1987 Seely ..... G09F 7/20 29/525.08
4,783,921 A * 11/1988 George ..... G09F 7/002 40/602
5,775,018 A * 7/1998 Steinborn ..... G02C 11/02 40/299.01
6,243,690 B1 * 6/2001 Adamec ..... G06F 3/147 235/383
6,971,198 B2 * 12/2005 Venegas, Jr. ..... E01F 15/003 40/600
7,257,915 B1 8/2007 Lovett et al.
D665,456 S * 8/2012 Bell ..... G09F 7/10 D20/18
2005/0166431 A1 * 8/2005 Boron ..... G09F 15/00 40/607.03
2007/0113449 A1 * 5/2007 Sinchok ..... G09F 15/00 40/607.06
2009/0217561 A1 * 9/2009 Thompson ..... G09F 3/203 40/606.12
2013/0192107 A1 * 8/2013 Blue ..... G09F 7/18 40/491
2015/0206462 A1 * 7/2015 Blue ..... G09F 7/10 40/491
2015/0302781 A1 * 10/2015 Jacobson ..... G09F 7/18 40/491

FOREIGN PATENT DOCUMENTS

EP 2 023 311 A1 2/2009
GB 2213968 A 8/1989

OTHER PUBLICATIONS

Examination Report No. 2 for copending Australian Application No. 2013373705, 6 pages, Jun. 26, 2017.

* cited by examiner

FUEL PUMP SIGN

CROSS-REFERENCE TO RELATED APPLICATIONS

This application claims priority to International Application No. PCT/GB2013/050074, filed Jan. 15, 2013, and titled "FUEL PUMP SIGN", the disclosure of which application is incorporated herein by reference.

The present invention relates to a sign for indicating which pumps are currently operational in a petrol station. The invention also relates to a fuel pump system and method for indicating which pumps are currently operational in a petrol station.

Petrol stations usually contain an array of pumps, some of which relate to different fuel types such as unleaded petrol, diesel and higher performance petrol. Typically, either a covering is placed over the handle of a pump to indicate that the pump is currently out of use or a cable tie is used to prevent the handle of the pump that is out of use from being removed. However, it can be difficult or impossible for an approaching driver to determine which of an array of pumps is currently out of use because the covering may be obscured by other parts of the pump array and a cable tie may not be visible from a distance. If the driver requires a particular fuel type, for example diesel, then the driver may mistakenly pull up next to a pump array in which the diesel pump is out of action. This results in wasted time for the driver and reduced revenue for the owner of the petrol station because the pump arrays are not used efficiently.

The above problem becomes more severe as demand for fuel increases. For example, petrol stations can become overcrowded when there is a peak in fuel demand due to industrial action or the threat of a future fuel shortage, with long queues to access pumps. In this situation it is even more important that the pumps are used efficiently, particularly as some pumps are likely to be empty due to the high demand.

Currently, drivers in a queue to access fuel pumps often inadvertently pull up next to a pump that is empty or out of use, or that can only supply the wrong type of fuel. The driver will then attempt to reach a different pump, which may be difficult or impossible due to the queue of drivers behind. Blockages in the flow of vehicles can result, adding to the delay in other drivers reaching the pumps.

According to a first aspect of the present invention, there is provided a fuel pump sign comprising a fuel type indicator panel for indicating the type of fuel supplied by a pump, and a pump availability indicator panel for indicating whether the pump is available for use.

Using the fuel pump sign of the present invention, a driver approaching the pump can easily see which pumps are operational and which pumps are out of use. The driver can also see which types of fuel are available at a given pump so that he/she does not pull up next to the wrong set of pumps.

Preferably, the fuel pump sign further comprises a fuel type panel holder adapted to hold the fuel type indicator panel detachably, and a pump availability panel holder adapted to hold the pump availability indicator panel detachably, wherein the fuel type panel holder and the pump availability panel holder are attachable to each other.

Preferably, the fuel type panel holder and the pump availability panel holder each include a rear plate and attachment portions adapted to hold the edges of the fuel type indicator panel and the pump availability indicator panel respectively.

Suitably, the fuel type indicator panel has a first fuel type indicated on one face thereof and a second fuel type different from the first fuel type indicated on the other face thereof, whereby the fuel type indicator panel is reversible to indicate different fuel types.

Preferably, the pump availability indicator panel has an indication that the pump is available for use on one face thereof and an indication that the pump is not available for use on the other face thereof, whereby the pump availability indicator panel is reversible to indicate whether or not the pump is available for use.

Conveniently, the pump availability panel holder is attached to one side edge of the fuel type panel holder, the fuel type panel holder is arranged so that the fuel type indicator panel can be inserted into the fuel type panel holder from above, and the pump availability panel holder is arranged so that the pump availability indicator panel can be inserted into the pump availability panel holder from a side of the pump availability panel holder opposite to a side to which the fuel type panel holder is attached.

Preferably, attachment portions are formed along the bottom edge and both side edges of the rear plate of the fuel type panel holder, and attachment portions are formed along the top and bottom edges of the rear plate of the pump availability panel holder and along a side edge of the rear plate of the pump availability panel holder adjacent to the one side edge of the fuel type panel holder.

Suitably, each attachment portion is a strip having an L-shaped cross-section, which is attached to the corresponding rear plate along one edge so as to form a slot between the attachment portion and the rear plate.

Preferably, the pump availability panel holder is detachably attachable to the fuel type panel holder.

Suitably, one of the pump availability panel holder and the fuel type panel holder has a tab and the other of the pump availability panel holder and the fuel type panel holder has a channel shaped to accommodate the tab, whereby the pump availability panel holder and the fuel type panel holder are attachable to each other by inserting the tab into the channel. Preferably, the tab is arrow-shaped.

Preferably, the fuel pump sign further comprises a fuel type panel holder adapted to hold the fuel type indicator panel detachably, wherein the fuel type panel holder and the pump availability indicator panel are attachable to each other. Suitably, the fuel type panel holder includes a rear plate and attachment portions adapted to hold the edges of the fuel type indicator panel.

In one embodiment, the pump availability indicator panel comprises a light for indicating whether the pump is available for use. Preferably, the pump availability indicator panel includes two lights, one light for indicating that the pump is available for use and the other light for indicating that the pump is not available for use. Suitably, the two lights are different colours.

Preferably, a light on the pump availability indicator panel is connected to a remote controller for switching the light on and off via a wired or wireless connection.

In a fuel pump sign for a double-sided fuel pump, the fuel pump sign as described above comprises a fuel type indicator panel and two pump availability indicator panels disposed on opposite sides of the fuel type indicator panel.

Preferably, there is provided a fuel pump array sign comprising a plurality of fuel pump signs as described above for indicating whether a plurality of fuel pumps in a fuel pump array are available for use. Preferably, the plurality of fuel pump signs are attached to each other in a vertical array.

Preferably, there is provided a fuel pump system comprising a fuel pump and a fuel pump sign as described above for indicating whether the fuel pump is available for use.

According to a second aspect of the present invention, there is provided a fuel pump system comprising a fuel pump and a display panel having a plurality of display areas, the display panel comprising a first display area for displaying an indication of a fuel type supplied by the pump, and a second display area for displaying an indication of whether or not the pump is available for use.

Preferably, the fuel pump sign is attached to the fuel pump.

Suitably, there is provided a fuel pump array system comprising a fuel pump array and a fuel pump array sign as described above.

According to a third aspect of the present invention, there is provided a fuel pump array system comprising a fuel pump array including a plurality of fuel pumps and a display panel having a plurality of display areas, the display panel comprising a first display area corresponding to each of the plurality of pumps, each first display area for displaying an indication of a fuel type supplied by the corresponding pump, and a second display area corresponding to each of the plurality of pumps, each second display area for displaying an indication of whether or not the corresponding pump is available for use.

Preferably, the fuel pump array sign is attached to the fuel pump array.

According to a fourth aspect of the present invention, there is provided a method of use of a display panel having a plurality of display areas as a fuel pump sign for indicating whether or not a fuel pump is available for use, the method of use comprising displaying an indication of a fuel type supplied by the pump on a first display area of the display panel, and displaying an indication of whether or not the pump is available for use on a second display area of the display panel.

In a method of use for indicating whether or not a double-sided fuel pump is available for use, the method of use as described above comprises displaying an indication of whether or not a first side of the pump is available for use on the second display area of the display panel, and displaying an indication of whether or not a second side of the pump is available for use on a third display area of the display panel, wherein the second display area and the third display area are arranged on opposite sides of the first display area.

In a method of use for indicating which fuel pumps are available for use of a fuel pump array having a plurality of fuel pumps, wherein the display panel has a first display area and a second display area corresponding to each of the plurality of fuel pumps in the fuel pump array, the method of use as described above comprises displaying an indication of a fuel type supplied by each pump on the corresponding first display area of the display panel, and displaying an indication of whether or not the pump is available for use on the corresponding second display area of the display panel.

Preferably, the method of use further comprises displaying one or more of traffic information, weather information and advertising on a fourth area of the display panel. Preferably, the display panel is an electronic display panel. Alternatively, the display panel is a mechanical display panel.

Embodiments of the present invention will now be described by way of further example only and with reference to the accompanying drawings, in which.

A typical pump array in a petrol station forecourt consists of three double-sided pumps arranged adjacent to each other, making six pumps in total. Each of the double-sided pumps supplies a different grade of fuel, for example standard unleaded petrol, super unleaded petrol and diesel.

Figure 2:
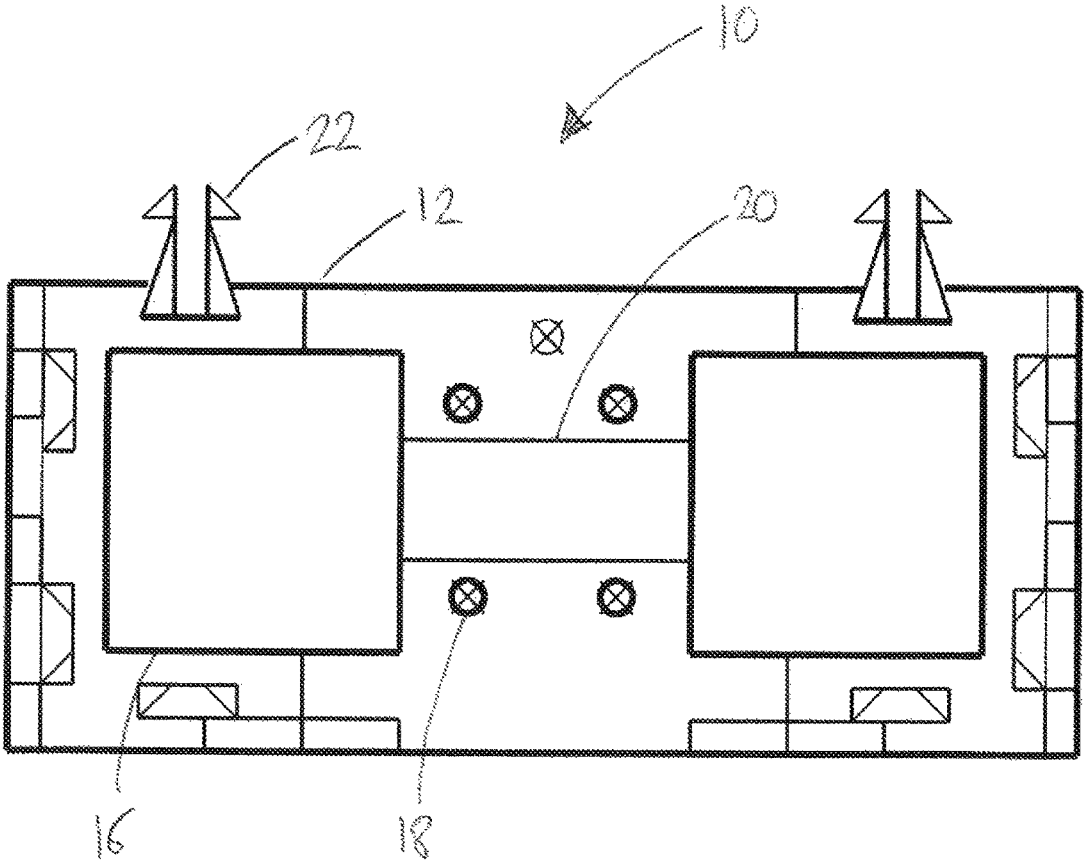
FIG. 2 is a rear view of the fuel type panel holder of FIG. 1.
Figure 3:
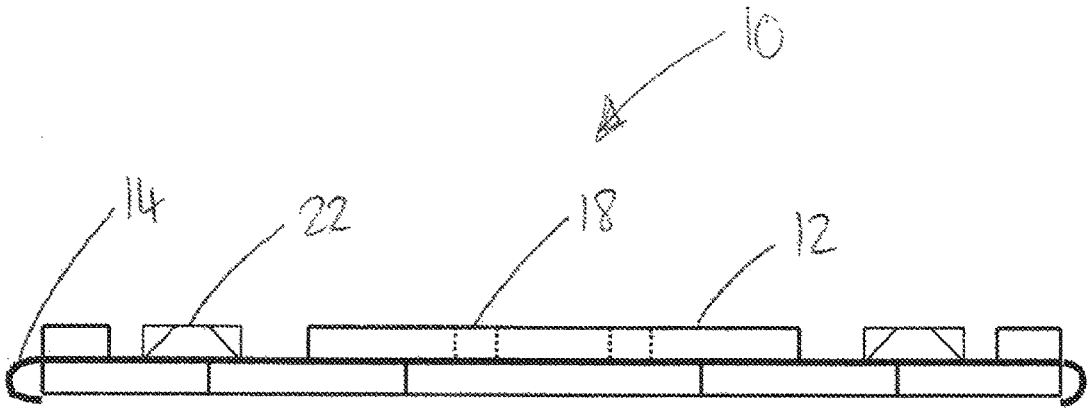
FIG. 3 is a top view of the fuel type panel holder of FIG. 1.

A first embodiment of the present invention is a sign 50 designed to be attached to or displayed next to a pump array such as that described above. The sign 50 is displayed so that a driver approaching the pump array can see the sign 50. The sign 50 indicates which of the six pumps is currently in operation, so that an approaching driver can see whether the grade of fuel he requires is available from the pump array and decide whether to pull up at the pump array accordingly. The sign 50 includes a fuel type panel holder 10 as shown in front view in FIG. 1, in rear view in FIG. 2 and in top view in FIG. 3. The sign 50 also includes at least one pump availability panel holder 30, an example of which is shown in front view in FIG. 4 and in top view in FIG. 5. A complete sign 50 consisting of two pump availability panel holders attached to either side of a fuel type panel holder 10 is shown in front view in FIG. 6.

Figure 1:
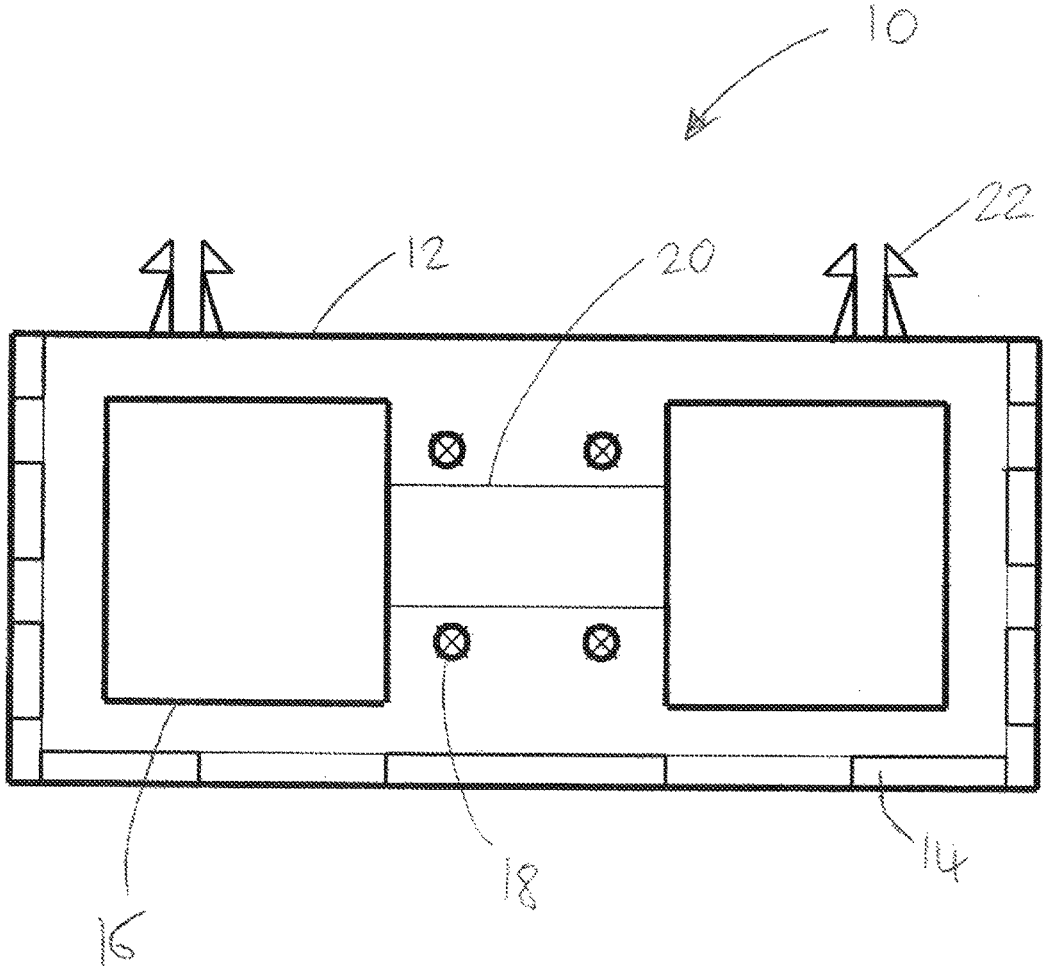
FIG. 1 is a front view of the fuel type panel holder of a sign according to a first embodiment of the invention.

The fuel type panel holder 10 has a rear plate 12, which comprises a sheet of material having two rectangular windows 16 cut out of it. The windows 16 make the sign 50 lighter. An indentation 20 is also formed in the strip of material separating the two windows, the indentation forming a channel connecting one window 16 to the other. In addition, four attachment holes 18 are formed in the strip of material separating the two windows 16, two holes 18 being formed on each side of the indentation 20 as shown in FIG. 1.

Figure 8:
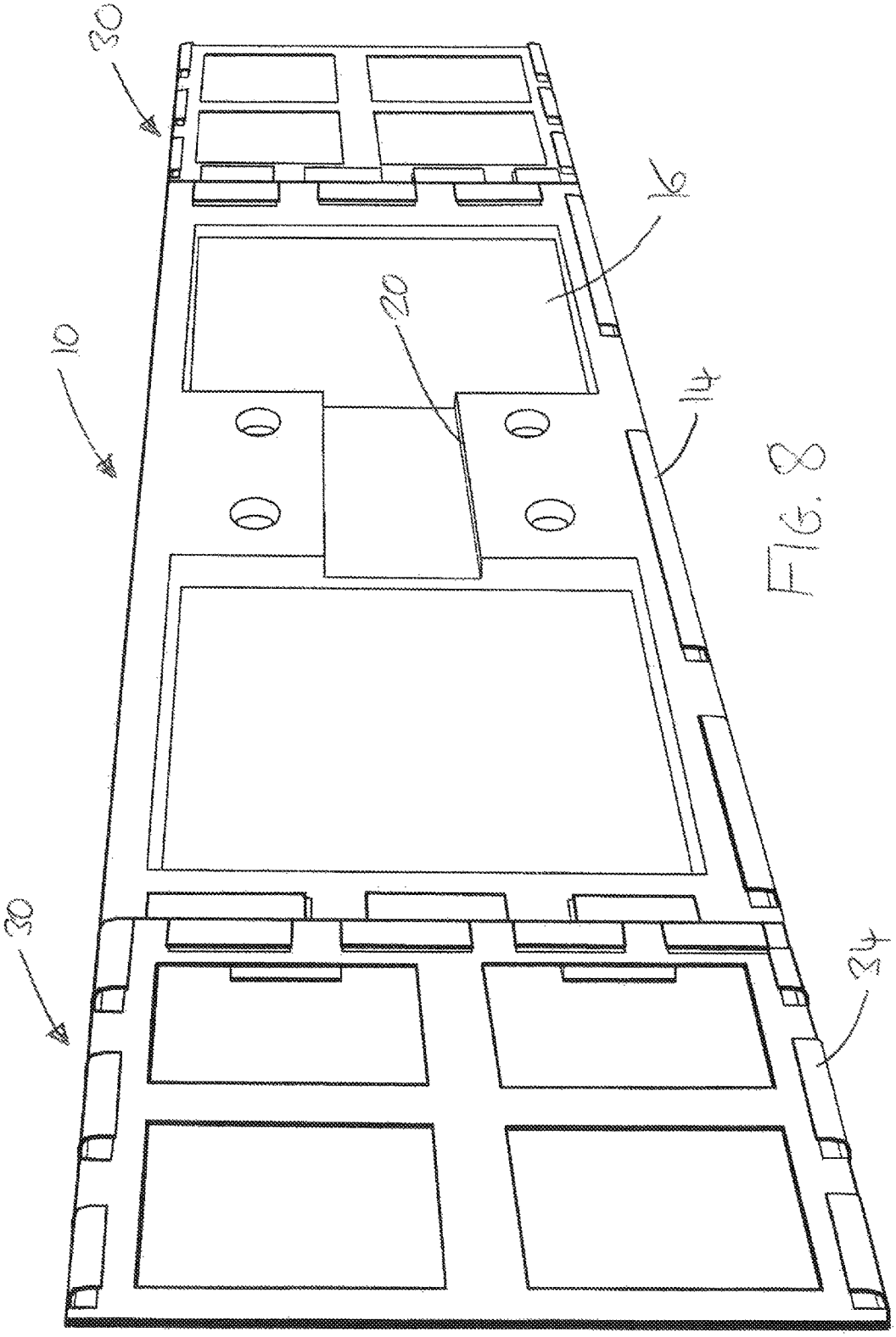
FIG. 8 is a perspective view of the sign according to the first embodiment of the invention without indicator panels inserted.

Attachment portions 14 having L-shaped cross-sections are formed around three edges of the rear plate 12, as shown most clearly in the perspective view of the sign 50 in FIG. 8. In this embodiment, three attachment portions 14 are formed along each of the left, right and bottom edges of the rear plate 12. The spaces between the attachment portions 14 and the rear plate 12 form slots into which the edges of a fuel type indicator panel 52 can be inserted, so that the fuel type indicator panel 52 is held in position parallel to the rear plate 12 by gravity and the attachment portions 14.

The fuel type indicator panel 52 is a sheet of material, on at least one side of which the name of a grade of fuel is displayed. The name may indicate the type of fuel or may be a brand name. It is preferred that the fuel type indicator panel 52 has two different names displayed on the two sides of the panel. With this feature, the sign 50 can be adapted to display an alternative fuel name by simply lifting the fuel type indicator panel 52 out of the fuel type panel holder 10, reversing the panel 52 and replacing it in the fuel type panel holder 10.

The fuel type panel holder 10 also includes arrow-shaped tabs 22 connected to the top edge of the rear plate 12 and correspondingly shaped channels (not shown) formed in the bottom edge of the rear plate 12. The arrow-shaped tabs 22 can be inserted into the bottom edge channels of the rear plate 12 of another fuel type panel holder 10 so that the two fuel type panel holders are clipped together, one above the other in parallel and in horizontal alignment. In this way, two or more fuel type panel holders can be joined together with fuel type indicator panels indicating the different fuel types available at the pump array to which the sign 50 is attached. Typically, three fuel type panel holders are joined together to indicate the fuel types available at three double-sided pumps in a pump array as described above.

The fuel type panel holder 10 also has channels (not shown) formed in the side edges of the rear plate 12, which are sized and shaped to receive tabs of a pump availability panel holder 30 so as to connect the fuel type panel holder 10 to the pump availability panel holder 30.

Figure 4:
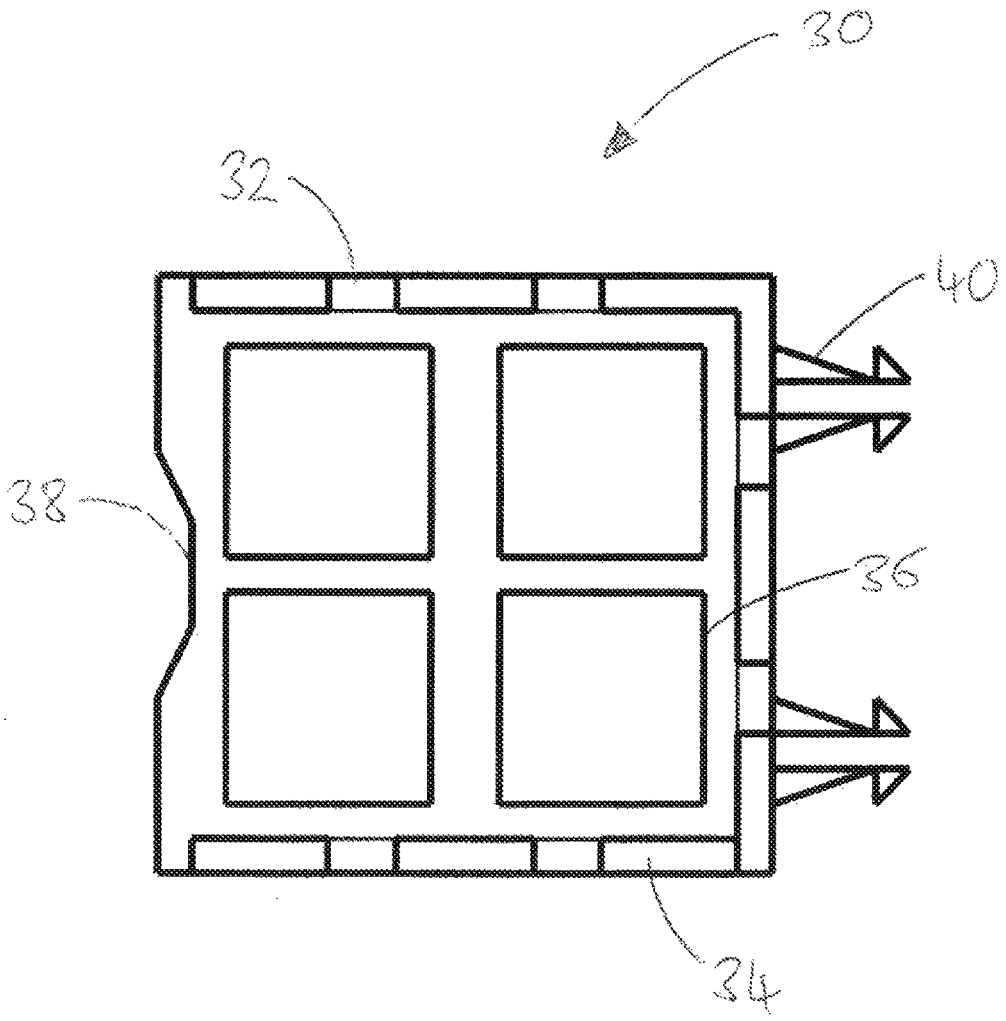
FIG. 4 is a front view of a pump availability panel holder of the sign according to the first embodiment of the invention.
Figure 5:
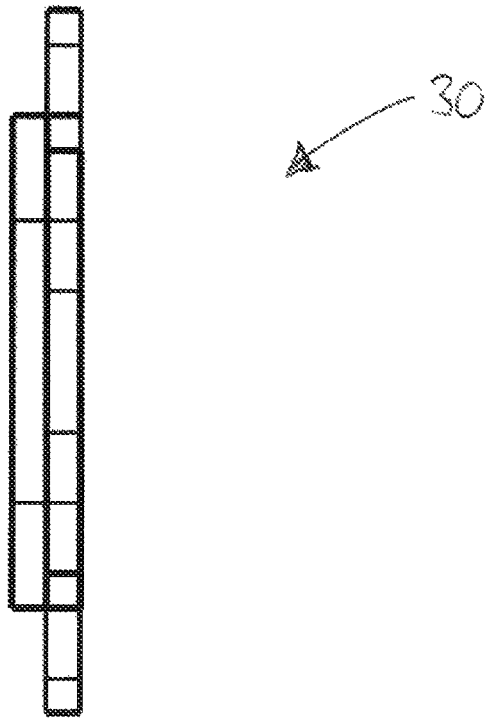
FIG. 5 is a top view of the pump availability panel holder of FIG. 4.

The pump availability panel holders 30 of the sign 50 each include a rear plate 32 and attachment portions 34 in the same way as the fuel type panel holders, as shown in FIG. 4. The rear plate 32 of the pump availability panel holder 30 has four rectangular windows 36 formed in it to reduce the weight of the pump availability panel holder 30 while retaining sufficient strength to support the sign 50. The rear plate 32 also includes a trapezoidal cut-out 38 formed in one side edge as shown in FIG. 4. The cut-out 38 allows a pump availability indicator panel 54 held in the pump availability panel holder 30 to be gripped and removed.

The attachment portions 34 of the pump availability panel holder 30 are L-shaped in cross-section and are formed around the top and bottom edges and one side edge of the rear plate 32. The one side edge is the side edge adjacent to the fuel type panel holder 10 as shown in FIG. 8. In this embodiment, three attachment portions 34 are formed along each of those three edges of the rear plate 32. The attachment portions 34 on the top and bottom edges adjacent to the one side edge may be connected to the uppermost and lowermost attachment portions 34 of the one side edge respectively, to form continuous attachment portions 34 having an L-shape in front view. The attachment portions 34 form slots into which the edges of a pump availability indicator panel 54 can be inserted, so that the pump availability indicator panel 54 is held in place parallel to the rear plate 32 by the attachment portions 34.

Figure 6:
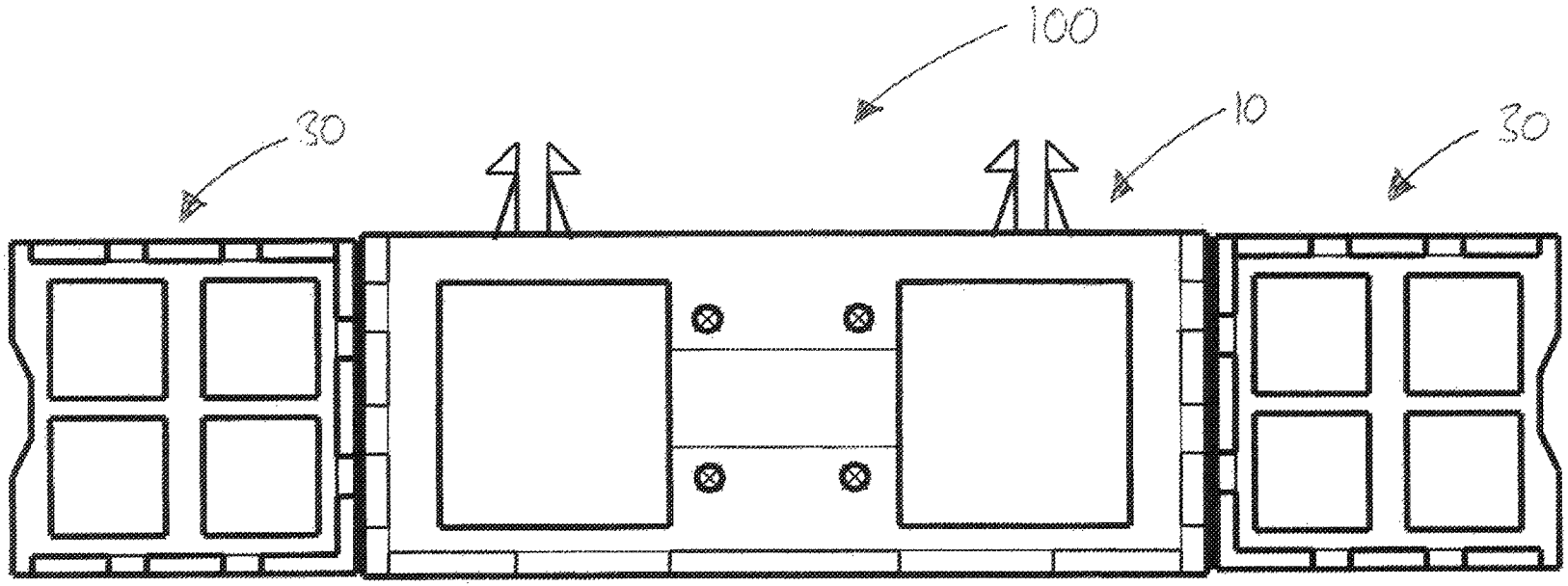
FIG. 6 is a front view of the sign according to the first embodiment of the invention without indicator panels inserted.

The pump availability panel holder 30 also includes arrow-shaped tabs 40 similar to those of the fuel type panel holder 10 described above. The tabs 40 extend from the side edge of the rear plate 32 of the pump availability panel holder 30 that has attachment portions 34 formed along it. The arrow-shaped tabs 40 are sized and shaped to form a force fit with the channels formed in the side edges of the rear plate 12 of the fuel type panel holder 10 described above. By inserting the tabs 40 into the channels of the fuel type panel holder 10, the pump availability panel holder 30 can be attached to either side of the fuel type panel holder 10 in parallel and in vertical alignment. Typically, one pump availability panel holder 30 is attached to each side of each fuel type panel holder 10 as shown in FIGS. 6 and 8. Each fuel type panel holder 10 of the sign 50 corresponds to a double-sided pump, and each pump availability panel holder 30 attached to the fuel type panel holder 10 corresponds to one pump of the double-sided pump. For the six pump array described above, the sign 50 would consist of three fuel type panel holders connected vertically, each fuel type panel holder 10 having two pump availability panel holders connected to it making six pump availability panel holders in total.

A pump availability indicator panel 54 is inserted into each pump availability panel holder 30 to indicate whether the corresponding pump is currently operational or out of use. The fuel type indicator panel 52 inserted into the attached fuel type panel holder 10 indicates the fuel type supplied by the corresponding pump. Each pump availability indicator panel 54 has an indication that the pump is operational displayed on one face of the panel and an indication that the pump is out of use displayed on the opposite face of the panel. If a pump is changed from being operational to being out of use or vice versa, the corresponding pump availability indicator panel 54 can simply be removed from the pump availability panel holder 30, reversed and replaced in the pump availability panel holder 30 to indicate this.

The pump availability indicator panels 54 and the fuel type indicator panels 52 can each have a hole formed through them, which allows the panel to be secured to the corresponding holder. The panel may be secured by a cable tie passed through the hole in the panel and through a window of the holder for example.

Figure 7:
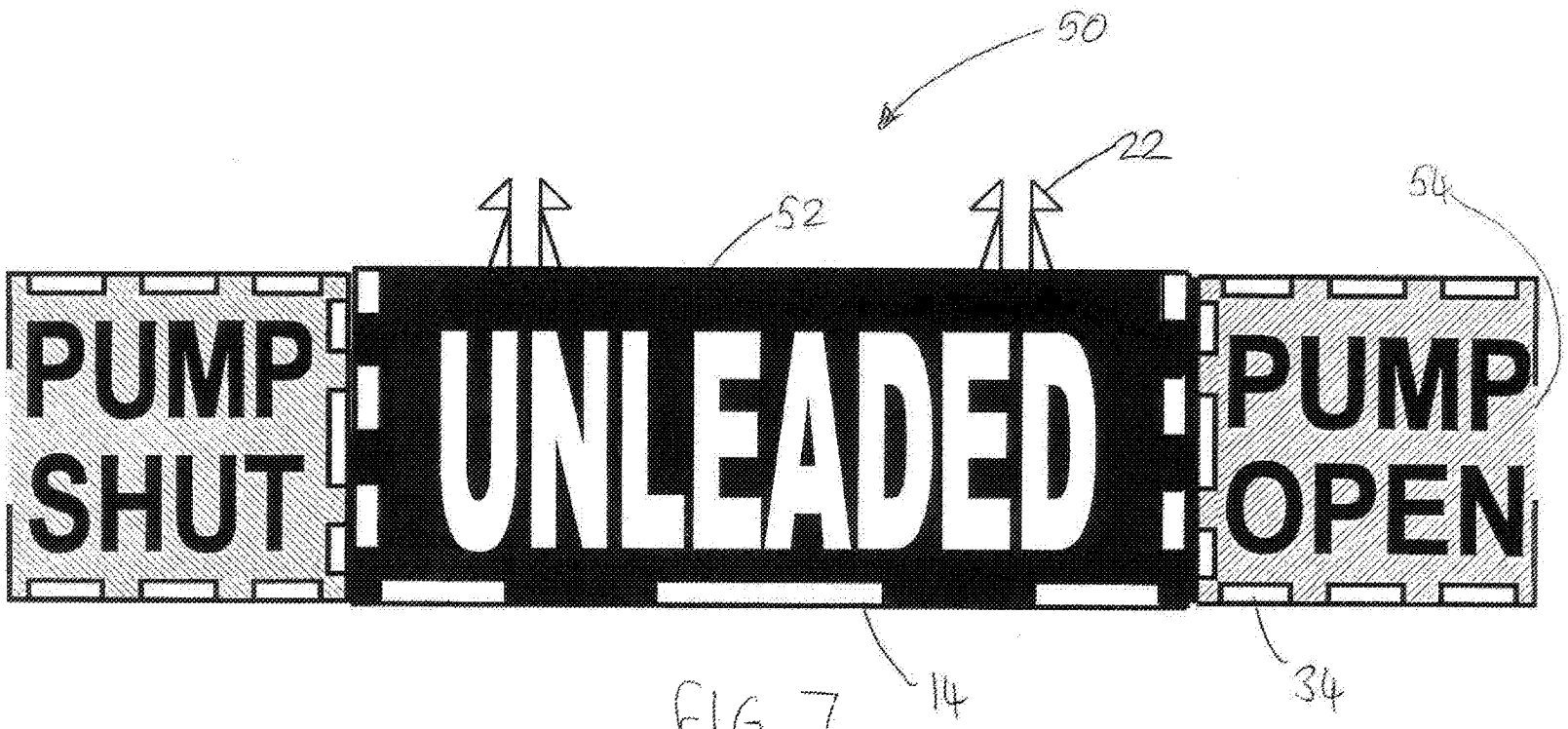
FIG. 7 is a front view of the sign according to the first embodiment of the invention with indicator panels inserted.

An example of a sign 50 according to the invention having a fuel type indicator panel 52 and pump availability indicator panels 54 inserted is shown in FIG. 7. The fuel type indicator panel 52 indicates that the fuel type of the corresponding double-sided pump is unleaded. The left pump availability indicator panel 54 indicates that the left hand pump of the double-sided pump is out of use. The right pump availability indicator panel 54 indicates that the right hand pump of the double-sided pump is operational. Using the pump sign 50 of the invention, an approaching driver can instantly see which of the pumps in the pump array are operational and which fuel types are available from that pump array. The driver can also easily decide which side of the double-sided pump array to pull up on to get the required fuel type. Due to the replaceable double-sided indicator panels 54 of the invention, it is quick and straightforward for a pump attendant to alter the sign 50 to correctly indicate which pumps are operational and which fuel types are available from a given pump array.

The sign 50 of the first embodiment can be attached to the pump array by any suitable means, or can be attached to a free-standing support and placed adjacent the pump array. For example, the fuel type panel holder 10 can be bolted or screwed to a surface of the pump array via the attachment holes 18 in the rear plate. The fuel type panel holder 10 may also be strapped to an upright post by a strap passing along the indentation 20 formed in the rear plate 12 of the fuel type panel holder 10 and around the post.

Alternative attachment means include applying adhesive strips to the rear surface of the rear plate 12 of the fuel type panel holder 10. Additional indentations may be formed in the rear surface of the rear plate 12 to accommodate the adhesive strips.

The precise location of the sign 50 relative to the pumps is not important as long as a driver approaching the pumps can see the sign 50. The driver should also be able to determine easily which pumps the sign is associated with.

Figure 9:
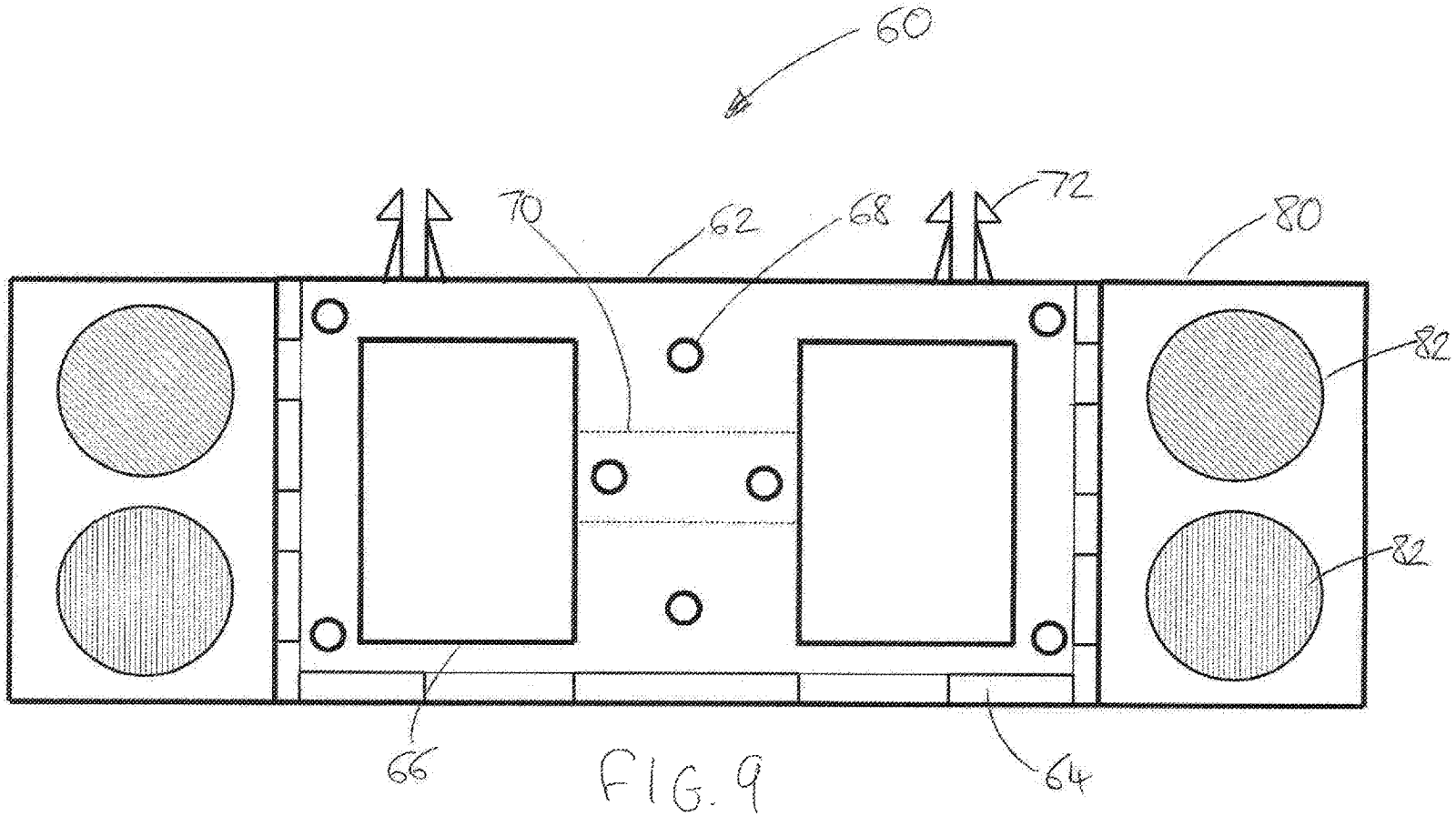
FIG. 9 is a front view of a semi-electronic sign according to a second embodiment of the invention.

A second embodiment of a sign according to the invention is shown in FIG. 9. The fuel type panel holder 60 of this sign is designed to hold a fuel type indicator panel 52 and is as described above, other than the different arrangement of attachment holes 68 shown in FIG. 9. The fuel type panel holder 60 of the second embodiment has a rear plate 62, attachment portions 64, windows 66, an indentation 70 and arrow-shaped tabs 72. The sign of this embodiment differs from that described above in that it is semi-electronic. The pump availability panel holders 30 of the sign described above are replaced in this embodiment by light panels 80 as shown in FIG. 9.

The light panels 80 can be connected to the side edges of the fuel type panel holder 60 by any suitable mechanism, for example the arrow-shaped tab and channel arrangement used to connect the pump availability panel holders 30 to the fuel type panel holder 10 in the first embodiment. Each light panel 80 has two lights 82 of different colours, red and green in this example. The green light is switched on to indicate that the corresponding pump is operational and the red light is switched on to indicate that the corresponding pump is out of use. Each light panel 80 is associated with one side of a double-sided pump supplying the fuel type indicated by the fuel type indicator panel 52 in the fuel type panel holder 60, as in the first embodiment.

The light panels 80 preferably use LED lights 82 but may also include incandescent or fluorescent bulbs. The light panels 80 may be powered by a battery or may be connected by any suitable means to the electricity supply of the pump array.

Control over which of the lights 82 on the light panel 80 is illuminated may be provided by a switch on the light panel 80 itself, but preferably the light panels are controlled remotely. For example, the light panels 80 may have wired or wireless control connections to a computer system at the counter of the petrol station shop. With this arrangement, an attendant can select which light 82 of each light panel 80 is illuminated from the computer system in the shop to ensure that the light panels 80 correctly indicate whether the associated pump is available for use.

Figure 10:
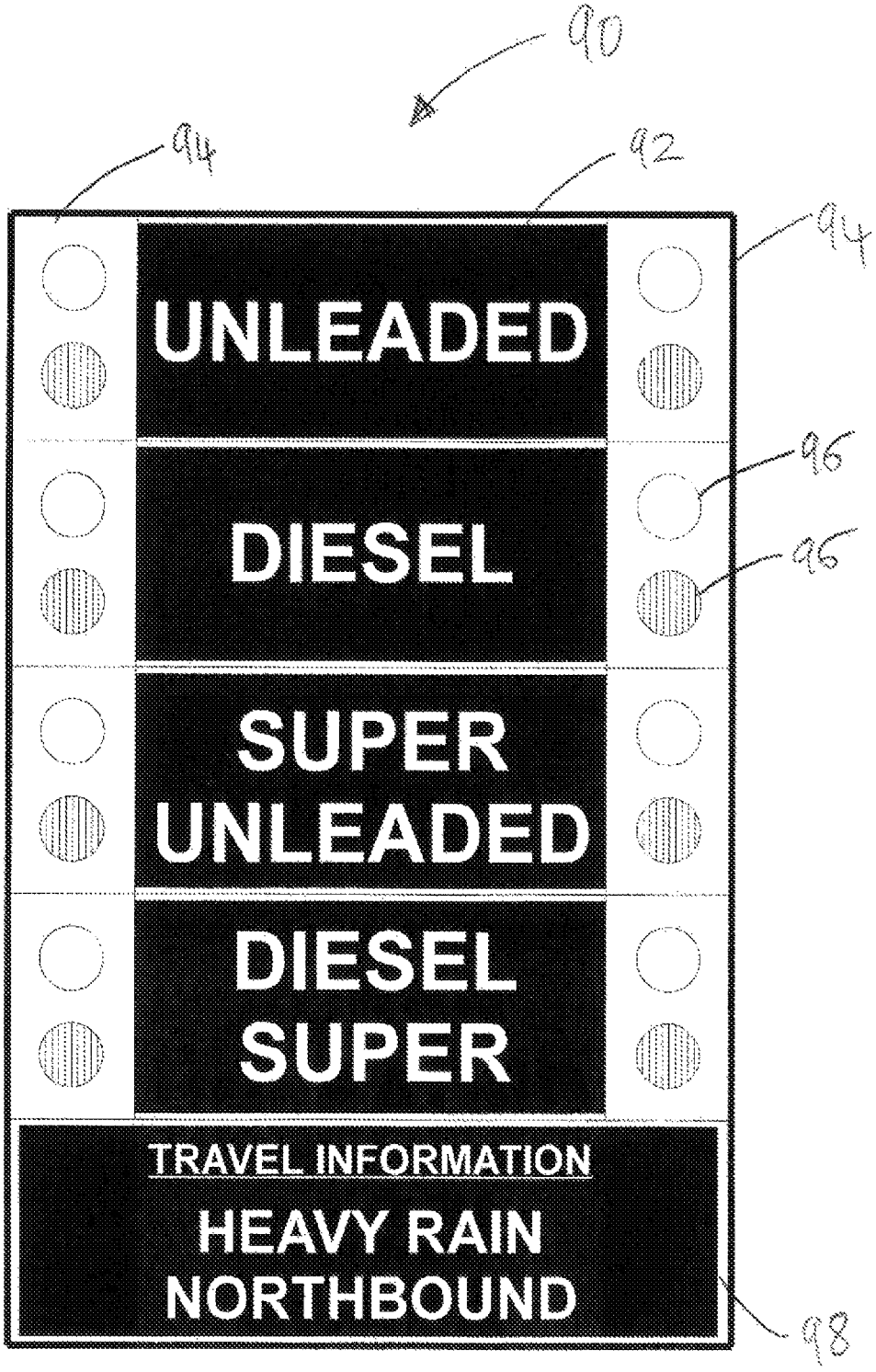
FIG. 10 is a front view of an electronic sign according to a third embodiment of the invention.

A third embodiment of the invention is shown in FIG. 10, which illustrates a fully electronic sign 90. The sign 90 in this embodiment consists of an electronic display such as an LCD or LED panel. The sign 90 is attached to or located near to a pump array in the same way as the signs of the first and second embodiments. The electronic display contains a display area 92, 94 corresponding to each double-sided pump. Each display area contains a first sub-area 92 indicating the type of fuel supplied by the associated double-sided pump and second and third sub-areas 94, each of the second and third sub-areas 94 indicating whether one side of the double-sided pump is operational or out of use. In this example, the display areas 92, 94 are each arranged to have a similar appearance to the semi-electronic sign of the second embodiment, with a central first sub-area 92 displaying the fuel type and second and third sub-areas 94 on either side of the first sub-area 92 displaying a red or green light 96 depending on whether the pump is out of use or operational.

In the third embodiment, the electronic display may also have an additional information display area 98, shown at the bottom of the sign in FIG. 10. This display area 98 can be used to display additional information of interest to drivers, for example traffic and weather information. This display area 98 may also be used to display advertising.

The foregoing description has been given by way of example only and it will be appreciated by a person skilled in the art that modifications can be made without departing from the scope of the present invention.

The invention claimed is:

1. A fuel pump sign comprising:

a fuel type indicator panel for indicating the type of fuel supplied by a pump;

a fuel type panel holder adapted to hold the fuel type indicator panel detachably;

a pump availability indicator panel for indicating whether the pump is available for use; and a pump availability panel holder adapted to hold the pump availability indicator panel detachably, wherein the pump availability panel holder is attached to one side edge of the fuel type panel holder;

the fuel type panel holder is arranged so that the fuel type indicator panel can be inserted into the fuel type panel holder from above; and the pump availability panel holder is arranged so that the pump availability indicator panel can be inserted into the pump availability panel holder from a side of the pump availability panel holder opposite to a side to which the fuel type panel holder is attached.

2. A fuel pump sign according to claim 1, wherein the fuel type panel holder and the pump availability panel holder each include a rear plate and attachment portions adapted to hold the edges of the fuel type indicator panel and the pump availability indicator panel respectively.

3. A fuel pump sign according to claim 1, wherein the fuel type indicator panel has a first fuel type indicated on one face thereof and a second fuel type different from the first fuel type indicated on the other face thereof, whereby the fuel type indicator panel is reversible to indicate different fuel types.

4. A fuel pump sign according to claim 1, wherein the pump availability indicator panel has an indication that the pump is available for use on one face thereof and an indication that the pump is not available for use on the other face thereof, whereby the pump availability indicator panel is reversible to indicate whether or not the pump is available for use.

5. A fuel pump sign according to claim 1, wherein the pump availability panel holder is detachably attachable to the fuel type panel holder.

6. A fuel pump sign according to claim 1, further comprising a fuel type panel holder adapted to hold the fuel type indicator panel detachably, wherein the fuel type panel holder and the pump availability indicator panel are attachable to each other.

7. A fuel pump sign according to claim 1 for a double-sided fuel pump, the fuel pump sign comprising a fuel type indicator panel and two pump availability indicator panels disposed on opposite sides of the fuel type indicator panel.

8. A fuel pump array sign comprising a plurality of fuel pump signs according to claim 1 for indicating whether a plurality of fuel pumps in a fuel pump array are available for use.

9. A fuel pump array sign according to claim 8, wherein the plurality of fuel pump signs are attached to each other in a vertical array.

10. A fuel pump array system comprising a fuel pump array and a fuel pump array sign according to claim 8.

11. A fuel pump system comprising a fuel pump and a fuel pump sign according to claim 1 for indicating whether the fuel pump is available for use.

12. A method of use of a display panel having a plurality of display areas as a fuel pump sign for indicating whether or not a fuel pump is available for use, the method of use comprising:

displaying an indication of a fuel type supplied by the pump on a first display area of the display panel; and displaying an indication of whether or not the pump is available for use on a second display area of the display panel.

13. A method of use according to claim 12 for indicating whether or not a double-sided fuel pump is available for use, the method of use comprising:

displaying an indication of whether or not a first side of the pump is available for use on the second display area of the display panel; and displaying an indication of whether or not a second side of the pump is available for use on a third display area of the display panel;

wherein the second display area and the third display area are arranged on opposite sides of the first display area.

14. A method of use according to claim 12 for indicating which fuel pumps are available for use of a fuel pump array having a plurality of fuel pumps, wherein the display panel has a first display area and a second display area corresponding to each of the plurality of fuel pumps in the fuel pump array, the method of use comprising:

displaying an indication of a fuel type supplied by each pump on the corresponding first display area of the display panel; and displaying an indication of whether or not the pump is available for use on the corresponding second display area of the display panel.

15. A method of use according to claim 12, wherein the display panel is an electronic display panel.

* * * * *